US007406279B2

(12) United States Patent
Chappell et al.

(10) Patent No.: US 7,406,279 B2
(45) Date of Patent: Jul. 29, 2008

(54) XEROGRAPHIC DEVELOPER UNIT HAVING MULTIPLE MAGNETIC BRUSH ROLLS ROTATING WITH THE PHOTORECEPTOR

(75) Inventors: James M. Chappell, Webster, NY (US); Patrick J. Howe, Fairport, NY (US); Michael D. Thompson, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 331 days.

(21) Appl. No.: 11/262,576

(22) Filed: Oct. 31, 2005

(65) Prior Publication Data

US 2007/0098457 A1 May 3, 2007

(51) Int. Cl.
*G03G 15/09* (2006.01)

(52) U.S. Cl. ..... 399/269; 399/276

(58) Field of Classification Search ..... 399/269, 399/267, 272, 276

See application file for complete search history.

(56) References Cited

U.S. PATENT DOCUMENTS 3,703,395 A * 11/1972 Drexler et al.
4,098,228 A 7/1978 Ruckdeschel et al.
4,537,495 A 8/1985 Kopko
4,811,046 A 3/1989 May
5,194,905 A 3/1993 Brewington
5,373,313 A * 12/1994 Kovacs
5,630,201 A 5/1997 Suzuki et al.
6,269,235 B1 * 7/2001 Nishiyama ..... 399/267
6,473,586 B2 10/2002 Noda et al.
6,525,753 B2 * 2/2003 Matsuda ..... 399/269

FOREIGN PATENT DOCUMENTS

JP 05045998 A * 2/1993
JP 2003066725 A * 3/2003

* cited by examiner

*Primary Examiner*—Susan S Lee
(74) *Attorney, Agent, or Firm*—Maginot, Moore & Beck

(57) ABSTRACT

A development subsystem is used to develop toner particles transported by semiconductive carrier particles. The development subsystem includes a developer housing for retaining a quantity of developer having semiconductive carrier particles and toner particles, a first magnetic roll having a stationary core with at least one magnet and a sleeve that rotates about the stationary core of the first magnetic roll, a second magnetic roll having a stationary core with at least one magnet and a sleeve that rotates about the stationary core of the second magnetic roll, a motor coupled to the first and the second magnetic rolls to drive the rotating sleeves of the first and the second magnetic rolls at different velocities relative to a velocity for a photoreceptor that rotates in proximity to the first and second magnetic rolls, the first and second magnetic rolls being driven in a direction that is with the direction of rotation of the photoreceptor so that the first and the second magnetic rolls carry semiconductive carrier particles and toner particles through a development zone formed by the first and the second magnetic rolls that is proximate to the photoreceptor.

16 Claims, 3 Drawing Sheets

XEROGRAPHIC DEVELOPER UNIT HAVING MULTIPLE MAGNETIC BRUSH ROLLS ROTATING WITH THE PHOTORECEPTOR

TECHNICAL FIELD

The present disclosure relates generally to an electrostatographic or xerographic printing machine, and more particularly concerns a development subsystem that uses semiconductive developer on a photoreceptor.

BACKGROUND

In the process of electrophotographic printing, a charge-retentive surface, also known as a photoreceptor, is charged to a substantially uniform potential, so as to sensitize the surface of the photoreceptor. The charged portion of the photoconductive surface is exposed to a light image of an original document being reproduced, or else a scanned laser image created by the action of digital image data acting on a laser source. The scanning or exposing step records an electrostatic latent image on the photoreceptor corresponding to the informational areas in the document to be printed or copied. After the latent image is recorded on the photoreceptor, the latent image is developed by causing toner particles to adhere electrostatically to the charged areas forming the latent image. This developed image on the photoreceptor is subsequently transferred to a sheet on which the desired image is to be printed. Finally, the toner on the sheet is heated to permanently fuse the toner image to the sheet.

One familiar type of development of an electrostatic image is called "two-component development." Two-component developer material largely comprises toner particles interspersed with carrier particles. The carrier particles are magnetically attractable, and the toner particles are caused to adhere triboelectrically to the carrier particles. This two-component developer can be conveyed, by means such as a "magnetic roll," to the electrostatic latent image, where toner particles become detached from the carrier particles and adhere to the electrostatic latent image.

In magnetic roll development systems, the carrier particles with the triboelectrically adhered toner particles are transported by the magnetic rolls through a development zone. The development zone is the area between the outside surface of a magnetic roll and the photoreceptor surface on which a latent image has been formed. Because the carrier particles are attracted to the magnetic roll, some of the toner particles are interposed between a carrier particle and the latent image on the photoreceptor. These toner particles are attracted to the latent image and transfer from the carrier particles to the latent image. The carrier particles are removed from the development zone as they continue to follow the rotating surface of the magnetic roll. The carrier particles then fall from the magnetic roll and return to the developer supply where they attract more toner particles and are reused in the development process. The carrier particles fall from the magnetic roll under the effects of gravity or are directed away from the roller surface by a magnetic field.

Different types of carrier particles have been used in efforts to improve the development of toner from two-component developer with magnetic roll development systems. One type of carrier particle is a very electrically insulated carrier and development systems using developer having these carrier particles typically develop lines and fine detail with high fidelity. Development efficiency for solid areas, however, is increased through low magnetic field agitation in the development zone along with close spacing to the latent image and elongation of the development zone. The magnetic field agitation helps prevent electric field collapse caused by toner countercharge in the development zone. The close spacing increases the effective electric field for a potential difference and the longer development zone provides more time for toner development. A disadvantage of this type of development system is the tendency for the carrier beads to retain countercharge left by toner particles that were developed from the brush. Retention of the countercharge causes carrier beads to be lost to the photoreceptor background areas. This loss is undesirable and leads to contamination problems in the xerographic system as well as depletion of the developer sump over time. Other two-component developers have used permanently magnetized carrier particles because these carrier particles dissipate toner countercharge more quickly by enabling a very dynamic mixing region to form on the magnetic roll.

One magnetic brush system uses electrically insulated carrier beads in the developer. Two magnetic rolls are used in such a system and the photoreceptor is in direct contact with the magnetic rolls. In fact, the photoreceptor is conformed or wrapped to the radial profiles of the magnetic rolls. The first roll, which encounters the latent image on the photoreceptor, rotates in a direction that is opposite to that of the photoreceptor. The second roll rotates in the same direction as the photoreceptor. The first roll rotates at a velocity approximately twice that of the photoreceptor while the second roll rotates at a velocity approximately 1.5 times of the photoreceptor. This type of system suffers from two limitations. For one, the development of single pixel dots at output rates of greater than 100 ppm is not always complete. For another, the system requires a third magnetic brush to scavenge objectionable levels of toner that has been deposited by the previous two magnetic brush rolls in the background or non-image areas of the photoreceptor.

Another type of carrier particle used in two-component developers is an electrically conductive carrier particle. Developers using this type of carrier particle are capable of being used in magnetic roll systems that produce toner bearing substrates at speeds of up to approximately 100 pages per minute (ppm). These developers typically recruit toner for the latent electrostatic image from areas near the tip of the developer magnetic brush that are proximate the surface of the photoconductor because the electric fields are high in this region. The electrical conductivity of the carrier particles serves to prevent development field collapse caused by the retention of toner countercharge and thereby allows high efficiency development, especially of solid area latent images. This type of developer, however, supplies an adequate amount of toner for high speed xerography with difficulty because the only toner available for development is the toner near the tip of the magnetic brush. Consequently, high development roller speeds are required. Unfortunately, high roller speeds increase the wear on the rollers and decrease the life of the rollers. Another problem that occurs with this type of developer is the tendency of the carrier particles, when the toner concentrations are low, to charge up in the image electric field. This charge causes the carrier particles to develop onto the image areas of the photoreceptor and leads to white spot deletions in the final image as well as carrier bead contamination in the system.

Another type of carrier particle used in two-component developers is the semiconductive carrier particle. Developers using this type of carrier particle are also capable of being used in magnetic roll systems that produce toner bearing substrates at speeds of up to approximately 100 pages per minute (ppm). Developers having semiconductive carrier particles use a relatively thin layer of developer on the magnetic roll in the development zone. This feature allows more of the toner to be recruited during development than thick brush conductive developers allow. In these systems an AC electric waveform is applied to the magnetic roller to cause the developer to become electrically conductive during the development process. The electrically conductive developer increases the efficiency of development by preventing development field collapse due to countercharge left in the magnetic brush by the developed toner. A typical waveform applied to these systems is, for example, a square wave at a peak to peak amplitude of 1000 Volts and a frequency of 9 KHz. This waveform controls both the toner movement and the electric fields in the development zone. Typically these systems run in a "with" mode, which means the magnetic roll surface runs in the same direction as the photoreceptor surface. This movement of the magnetic rolls in the same direction as the photoreceptor tends to keep background development low, but it has been observed to produce inadequate development unless high magnetic roller surface speeds are used to get an adequate supply of toner into the development zone. This high magnetic roll surface speed requires high strength magnets to control the developer bed. These types of magnets are expensive. Additionally, high speeds also increase the wear on bearings in the developer housing.

Another limitation of known magnetic roll systems used with developers having semiconductive carrier particles is the difficulty in extending the development zone to increase the time in which toner development may occur. One method for increasing development zone length with other developers having insulated or conductive carrier particles is to use two magnetic rolls. The two rolls are placed close together with their centers aligned to form a line that is parallel to the photoreceptor. Because the developer layer for semiconductive carrier particle developer is so thin, magnetic fields sufficiently strong enough to cause semiconductive carrier particles to migrate in adequate quantities from one magnetic roll to the other magnetic roll also interfere with the transfer of toner from the carrier particles in the development zones. Consequently, construction of the magnetic rolls requires careful consideration of this interference. If two rolls are not able to be used to increase the development zone, then the radius of the magnetic roll may be increased to accommodate this goal. There is a limit, however, to the diameter of the magnetic roll. One limit is simply the area within the printing machine that is available for a development subsystem. Another limit is the size and strength of the magnets internal to the magnetic roll that are required to provide adequate magnetic field strengths and shapes at the surface of a larger magnetic roll.

Another problem with semiconductive development systems is a defect in which the system has trouble developing a halftone adjacent and following a solid so a halo of the solid is left at the boundary of the halftone. This happens at high toner concentrations and limits the latitude of the system.

The systems and methods discussed below address the limitations of development subsystems using developer having semiconductive carrier particles that have been noted.

SUMMARY

A development subsystem is used to develop toner having semiconductive carrier particles and toner particles. The development subsystem increases the time for developing the toner and provides an adequate supply of developer for good single pixel resolution at high output rates. The subsystem includes a developer housing for retaining a quantity of developer having semiconductive carrier particles and toner particles, a first magnetic roll having a stationary core with at least one magnet and a sleeve that rotates about the stationary core of the first magnetic roll, a second magnetic roll having a stationary core with at least one magnet and a sleeve that rotates about the stationary core of the second magnetic roll, a motor coupled to the first and the second magnetic rolls to drive the rotating sleeves of the first and the second magnetic rolls at different velocities relative to a velocity for a photoreceptor that rotates in proximity to the first and second magnetic rolls, the first and second magnetic rolls being driven in a direction that is with the direction of rotation of the photoreceptor so that the first and the second magnetic rolls carry semiconductive carrier particles and toner particles through a development zone in a gap formed by the first and the second magnetic rolls and the photoreceptor.

A method for developing tone carried by semiconductive carrier particles in an electrostatographic printing machine includes retaining a quantity of developer having semiconductive carrier particles and toner particles, transporting a portion of the retained developer through a development zone formed by a first sleeve rotating at a first velocity about a first magnetic core and a second sleeve rotating at a second velocity about a second magnetic core for development on a photoreceptor, the first rotating sleeve and the second rotating sleeve rotating in a direction through the development zone that is with the direction of the photoreceptor rotating through the development zone and the second velocity being less than the first velocity.

An electrostatographic printing machine that more precisely develops single pixels at high output rates includes a photoreceptor that continuously moves about a circuit, a raster output scanner (ROS) that generates a latent image on a portion of the photoreceptor as it moves past the ROS, a development station for developing toner on the latent image, a transfer station for transferring the developed toner to a substrate, a fusing station for fixing the transferred toner to the substrate; and the development station further comprises a developer housing for retaining a quantity of developer having semiconductive carrier particles and toner particles, a first magnetic roll having a stationary core with at least one magnet and a sleeve that rotates about the stationary core of the first magnetic roll, a second magnetic roll having a stationary core with at least one magnet and a sleeve that rotates about the stationary core of the second magnetic roll, a motor coupled to the first and the second magnetic rolls to drive the rotating sleeves of the first and the second magnetic rolls at different velocities relative to a velocity for a photoreceptor that rotates in proximity to the first and second magnetic rolls, the first and second magnetic rolls being driven in a direction that is with the direction of rotation of the photoreceptor so that the first and the second magnetic rolls carry semiconductive carrier particles and toner particles through a development zone in a gap formed by the first and the second magnetic rolls and the photoreceptor.

DETAILED DESCRIPTION

Figure 1:
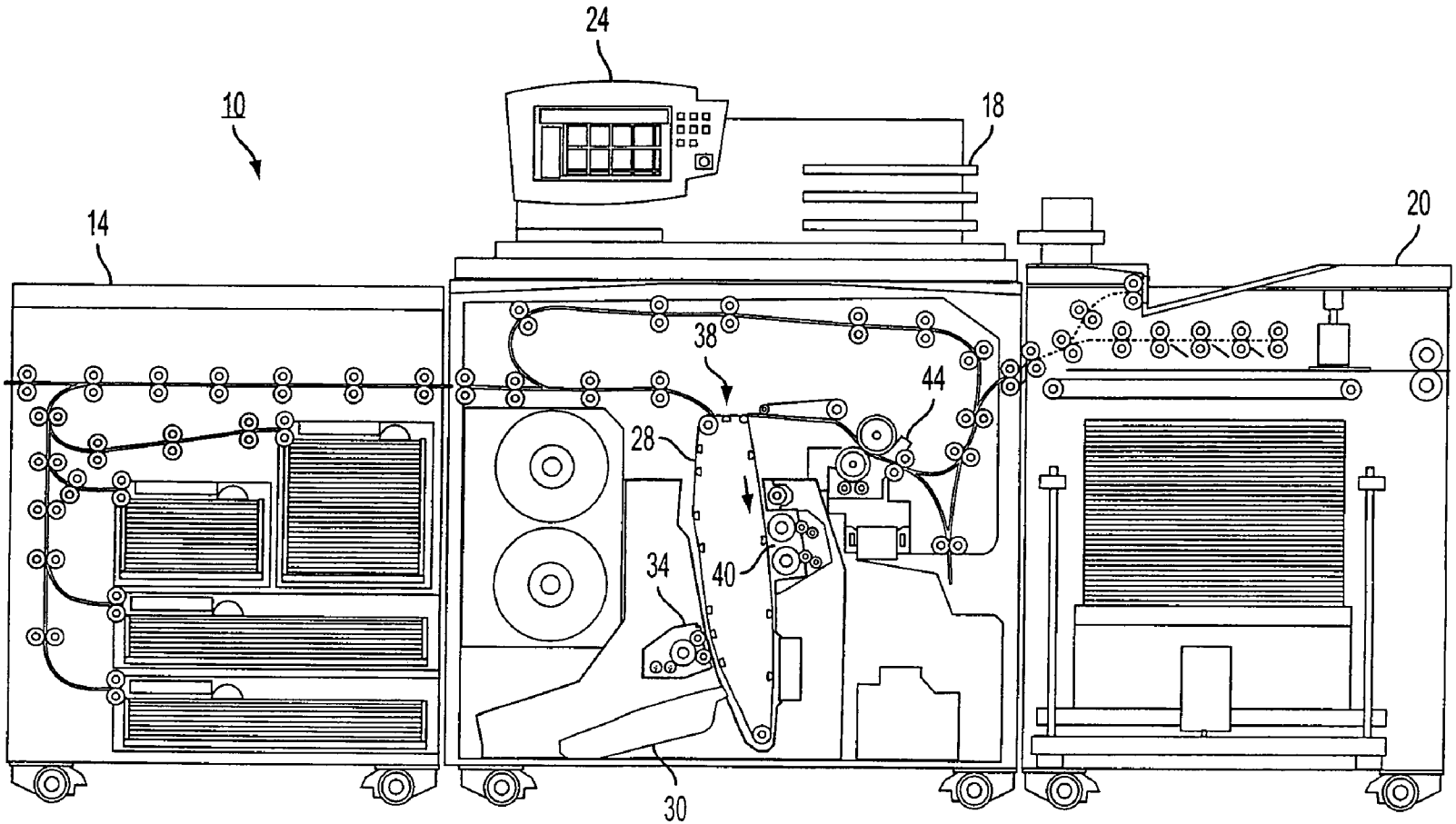
FIG. 1 is an elevational view of an electrostatographic printing apparatus incorporating a semiconductive magnetic brush development (SCMB) system having two magnetic rolls that rotate in the same direction as the photoreceptor.

FIG. 1 is an elevational view of an electrostatographic printing apparatus 10, such as a printer or copier, having a development subsystem that uses two magnetic rolls for developing toner particles that are carried on semiconductive carrier particles. The machine 10 includes a feeder unit 14, a printing unit 18, and an output unit 20. The feeder unit 14 houses supplies of media sheets and substrates onto which document images are transferred by the printing unit 18. Sheets to which images have been fixed are delivered to the output unit 20 for correlating and/or stacking in trays for pickup.

The printing unit 18 includes an operator console 24 where job tickets may be reviewed and/or modified for print jobs performed by the machine 10. The pages to be printed during a print job may be scanned by the printing machine 10 or received over an electrical communication link. The page images are used to generate bit data that are provided to a raster output scanner (ROS) 30 for forming a latent image on the photoreceptor 28. Photoreceptor 28 continuously travels the circuit depicted in the figure in the direction indicated by the arrow. The development subsystem 34 develops toner on the photoreceptor 28. At the transfer station 38, the toner conforming to the latent image is transferred to the substrate by electric fields generated by the transfer station. The substrate bearing the toner image travels to the fuser station 44 where the toner image is fixed to the substrate. The substrate is then carried to the output unit 20. This description is provided to generally describe the environment in which a double magnetic roll development system for developer having semiconductive carrier particles may be used and is not intended to limit the use of such a development subsystem to this particular printing machine environment.

Figure 2:
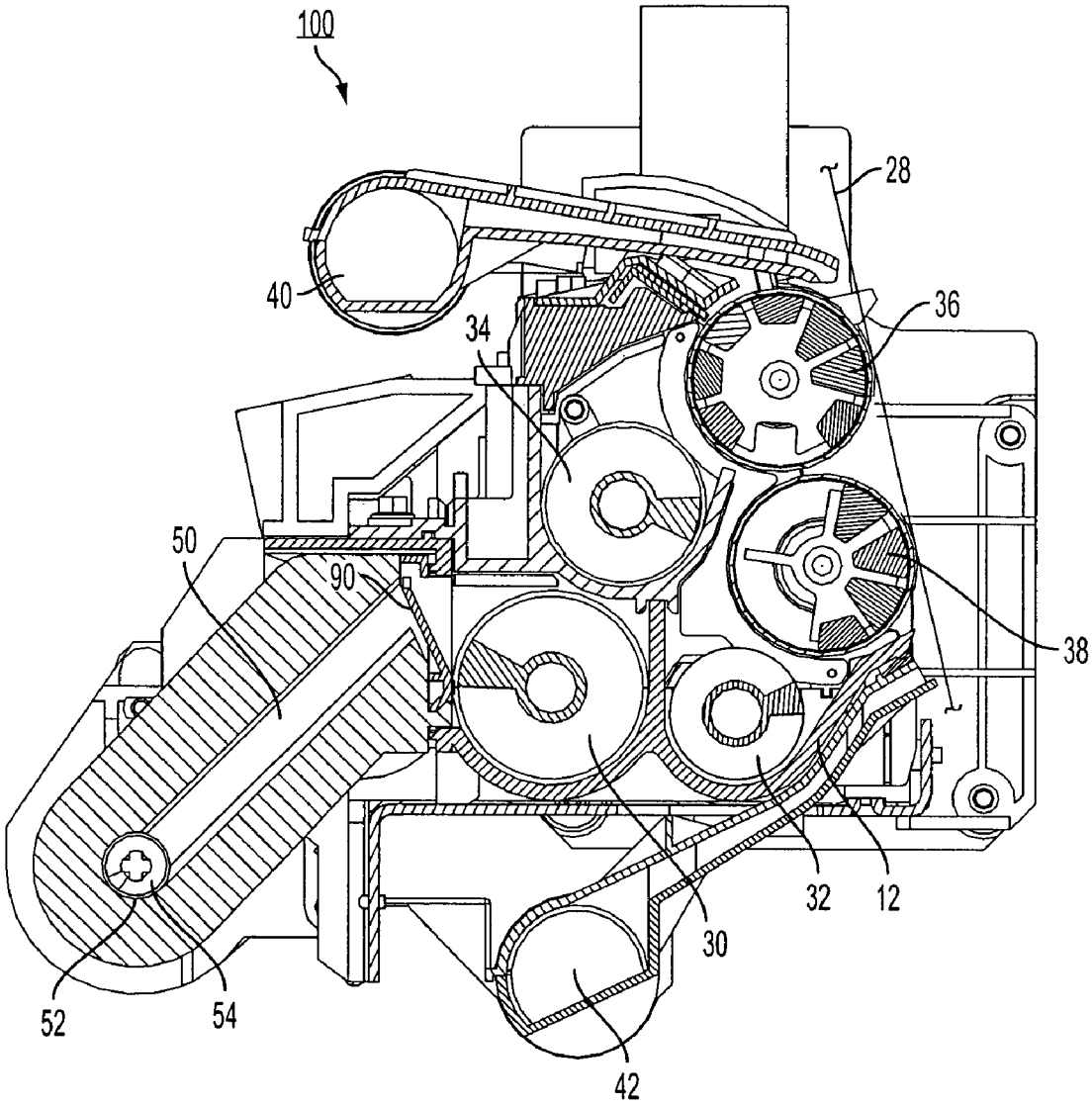
FIG. 2 is a sectional view of a SCMB developer unit having two magnetic rolls that rotate in the same direction as the photoreceptor.

The overall function of developer unit 100, which is shown in FIG. 2, is to apply marking material, such as toner, onto suitably-charged areas forming a latent image on an image receptor such as the photoreceptor 28, in a manner generally known in the art. The developer unit 100, however, enables more complete development of single pixels at relatively high output rates from developer using semiconductive carrier particles than development systems previously known. Additionally, the developer station 100 does not require a third magnetic roller for scavenging toner from the background areas of the photoreceptor. In various types of printers, there may be multiple such developer units 100, such as one for each primary color or other purpose.

Among the elements of the developer unit 100, which is shown in FIG. 2, are a housing 120, which functions generally to hold a supply of developer material having semiconductive carrier particles, as well as augers, such as 30, 32, 34, which variously mix and convey the developer material, and magnetic rolls 36, 38, which in this embodiment form magnetic brushes to apply developer material to the photoreceptor 28. Other types of features for development of latent images, such as donor rolls, paddles, scavengeless-development electrodes, commutators, etc., are known in the art and may be used in conjunction with various embodiments pursuant to the claims. In the illustrated embodiment, there is further provided air manifolds 40, 42, attached to vacuum sources (not shown) for removing dirt and excess particles from the transfer zone near photoreceptor 28. As mentioned above, a two-component developer material is comprised of toner and carrier. The carrier particles in a two-component developer are generally not applied to the photoreceptor 28, but rather remain circulating within the housing 12.

In one embodiment, the development housing retains developer having magnetic, ferrite core carrier particles having a nominal diameter of approximately 35 μm and toner particles having a nominal diameter of approximately 8.5 μm. At a toner concentration level of approximately 8%, the developer material has a nominal resistivity of approximately 10.2 to approximately 12.5 log ohm. A similar voltage is applied to each of the magnetic rollers 36, 38 for the generation of nominal electrostatic conditions for development of the toner. Such conditions may be generated by applying a voltage that is approximately 250 VDC less than the latent image potential and approximately 150 VDC more than the photoreceptor background potential. An AC square waveform with an amplitude of approximately 1.0 kV peak to peak with a frequency of approximately 9.0 KHz and a non-symmetrical 65% duty cycle may also be applied to the roller potentials.

Figure 3:
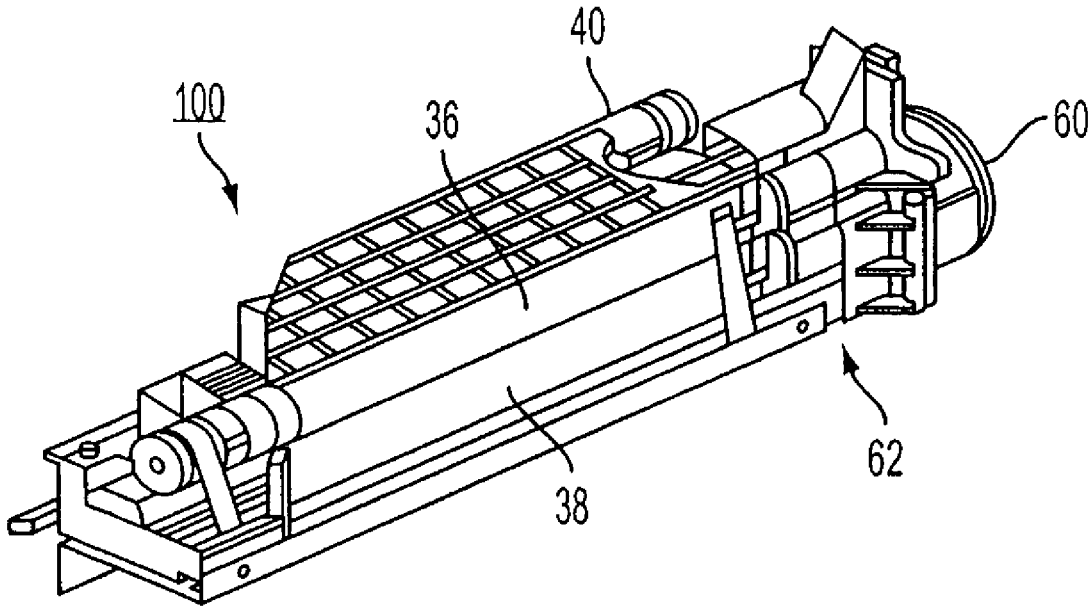
FIG. 3 is a perspective view of a SCMB developer unit having two magnetic rolls that rotate in the same direction as the photoreceptor.

FIG. 3 is a perspective view of a portion of developer unit 100. As can be seen in this embodiment, the upper magnetic roll 36 and the lower magnetic roll 38 form a development zone that is approximately as long as the two diameters of the magnetic rolls 36 and 38. The magnetic rollers 36 and 38 may be made from stainless steel or aluminum and are textured. Texturing of a magnetic roll may be achieved by sandblasting the roller to achieve a specified surface roughness. As further can be seen, a motor 60 is used with a mechanism, generally indicated with reference numeral 62, to cause rotation of the various augers, magnetic rolls, and any other rotatable members within the developer unit 100 at various relative velocities. There may be provided any number of such motors. The magnetic rolls 36 and 38 are rotated in a direction that is the same as the direction in which the photoreceptor moves past the developer unit 100. That is, the two magnetic rolls are operated in the with mode for development of toner. The magnetic roller that first encounters the latent image on the photoreceptor 28, which in the figure is magnetic roll 36, is driven at a velocity that is greater than the second magnetic roll to encounter the latent image, which in the figure is roller 38. The slower speed of the second magnetic brush helps increase the mass of toner per unit area on the roller. The additional toner changes the development characteristic of the development nip in a way that extends the life of the development system without significantly impacting the solid area densities developed by the subsystem.

In one embodiment of the developer unit 100, the motor 60 and the mechanism 62 cause the magnetic rolls to rotate at a speed in the range of about 1 to about 1.5 times the rotational speed of the photoreceptor 28 with the first magnetic roller encountering the latent image being driven at a velocity in this range that is greater than a velocity in this range at which the second magnetic roller is driven. That is, the two magnetic rolls are driven at different surface velocities within this range. The differential velocity control enables more complete pixel resolution at relatively higher output rates. Additionally, levels of toner developed in background areas are acceptable and do not require a third magnetic roller for scavenging toner.

In another embodiment of the differential velocity control system, the first magnetic roller to encounter the latent image is driven at a velocity that is approximately 1.5 times the surface velocity of the photoreceptor while the second magnetic roller is driven at a velocity that is slower than the velocity of the first roller, but not less than approximately the surface velocity of the photoreceptor. In another embodiment of the differential velocity control system, the second magnetic roller to encounter the latent image is driven at a velocity that is approximately the surface velocity of the photoreceptor while the first magnetic roller is driven at a velocity that is greater than the velocity of the first roller, but not greater than approximately 1.5 times the surface velocity of the photoreceptor. In another embodiment of the differential velocity control system, the first magnetic roller to encounter the latent image is driven at a velocity that is approximately 1.5 times the surface velocity of the photoreceptor while the second magnetic roller is driven at a velocity that is approximately the surface velocity of the photoreceptor.

To control the relative velocities of the magnetic rollers 36 and 38 a motor controller is provided. The motor controller is coupled to the machine controller for the system 10. Each magnetic roller has at least one motor coupled to the roller for driving the roller at a target velocity. The machine controller provides the target velocities for the motor(s) to the motor controller. The motor controller may control more than one motor or a separate control circuit may be provided for each motor.

A motor controller for controlling multiple motors may be coupled to a motor for driving roller 36 and to a motor for driving roller 38. The motor controller receives from the machine controller a target motor speed for each motor driving a magnetic roller. The target motor speeds correspond to the desired roller velocity and are derived from the surface velocity of the photoreceptor as described above. The motor controller provides a velocity signal to each motor corresponding to the target motor speed for each motor and controls the speed of the motor through a proportional-integral-derivative controller. The motor controller receives a signal from each motor indicative of the motor's speed and adjustments are made to the speed control signal to maintain the motor at the target speed.

Although the various embodiments described above have been discussed with regard to an arrangement in which the developer is distributed from an upper magnetic roll to a lower magnetic roll, the reverse may also be used in another embodiment. In such an embodiment, the developer having semiconductive carrier particles is picked up by the lower magnetic roll and then transferred from the lower magnetic roll to the upper magnetic roll. At the upper magnetic roll, the semiconductive carrier particles are removed by gravity or the magnetic field generated by one or more magnets in the upper magnetic roll or a combination of gravity and magnetic fields. The removed carrier particles are returned to the developer supply.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A development subsystem for an electrostatographic printing machine, comprising:

a developer housing for retaining a quantity of developer having semiconductive carrier particles and toner particles;

a first magnetic roll having a stationary core with at least one magnet and a sleeve that rotates about the stationary core of the first magnetic roll;

a second magnetic roll having a stationary core with at least one magnet and a sleeve that rotates about the stationary core of the second magnetic roll, the first and the second magnetic rolls being arranged in the developer housing to form a development zone in which the first magnetic roll presents developer to a photoreceptor surface before any other magnetic roll in the developer housing presents developer to the photoreceptor surface as the photoreceptor surface passes in a direction through the development zone; and a motor coupled to the first and the second magnetic rolls to drive the sleeve of the first magnetic roll at a velocity that is greater than a velocity at which the second magnetic roll is driven, the first and second magnetic rolls being driven in a direction that is with the direction the photoreceptor surface passes through the development zone.

2. The subsystem of claim 1 wherein the first and the second magnetic rolls are each driven at a velocity that is in a range of about 1 to about 1.5 times a velocity at which the photoreceptor surface passes the first and the second magnetic rolls.

3. The subsystem of claim 2 wherein the sleeve of the first magnetic roll is driven at a velocity that is approximately 1.5 times the velocity of the photoreceptor surface as the photoreceptor surface passes the first and the second magnetic rolls.

4. The subsystem of claim 3, wherein the sleeve of the second magnetic roll is driven at a velocity that is approximately 1.1 times the velocity at which the photoreceptor surface passes the first and the second magnetic rolls.

5. The subsystem of claim 2 wherein the sleeve of the second magnetic roll is driven at a velocity that is approximately 1.1 times the velocity at which the photoreceptor surface passes the first and the second magnetic rolls.

6. The subsystem of claim 5, wherein the sleeve of the first magnetic roll is driven at a velocity that is approximately 1.5 times the velocity at which the photoreceptor surface passes the first and the second magnetic rolls.

7. The subsystem of claim 1, wherein the motor drives the sleeves of the first magnetic roll and the second magnetic roll to transfer the semiconductive carrier particles upwardly through the development zone while the photoreceptor surface passes upwardly through the development zone.

8. The subsystem of claim 1, wherein the motor drives the sleeves of the first magnetic roll and the second magnetic roll to transfer the semiconductive carrier particles downwardly through the development zone while the photoreceptor surface passes downwardly through the development zone.

9. A method for developing developer having semiconductive carrier particles in an electrostatographic printing machine, comprising:

retaining a quantity of developer having semiconductive carrier particles and toner particles;

driving a first sleeve about a first magnetic core at a first velocity to present developer to a photoreceptor surface before any other sleeve rotating about a magnetic core presents developer to the photoreceptor; and driving a second sleeve about a second magnetic core at a second velocity that is less than the first velocity, the second sleeve receiving developer from the first sleeve for development of a latent image on a photoreceptor, the first sleeve and the second sleeve rotating in a direction that is with the photoreceptor surface as the photoreceptor surface passes by the first sleeve and the second sleeve.

10. The method of claim 9, the driving of the first sleeve comprising:

rotating the first sleeve at the first velocity that is about 1.5 times a velocity at which the photoreceptor surface passes by the first sleeve and the second sleeve.

11. The method of claim 9, the driving of the second sleeve comprising:

rotating the second sleeve at the second velocity that is about 1.1 times a velocity at which the photoreceptor surface passes by the first sleeve and the second sleeve.

12. The method of claim 10, the driving of the second sleeve comprising:

rotating the second sleeve at the second velocity that is about 1.1 time the velocity at which the photoreceptor surface passes by the first sleeve and the second sleeve.

13. A printing unit for an electrostatographic printing machine comprising:

a photoreceptor that continuously moves about a circuit;

a raster output scanner (ROS) that generates a latent image on a portion of the photoreceptor as the photoreceptor moves past the ROS;

a development station for developing toner on the latent image;

a transfer station for transferring the developed toner to a substrate;

a fusing station for fixing the transferred toner to the substrate; and the development station further comprising:

a developer housing, for retaining a quantity of developer having semiconductive carrier particles and toner particles;

a first magnetic roll having a stationary core with at least one magnet and a sleeve that rotates about the stationary core of the first magnetic roll at a first velocity;

a second magnetic roll having a stationary core with at least one magnet and a sleeve that rotates about the stationary core of the second magnetic roll at a second velocity, the second velocity being slower than the first velocity and the first and the second magnetic rolls being arranged in the developer housing to form a development zone in which the first magnetic roll presents developer to the latent image on the photoreceptor before any other magnetic roll in the developer housing presents developer to the latent image on the photoreceptor as the photoreceptor passes in a direction through the development zone;

a motor coupled to the first and the second magnetic rolls to drive the sleeves of the first and the second magnetic rolls in a direction that is with the direction of the photoreceptor as the photoreceptor passes through the development zone and the first and the second magnetic rolls carry semiconductive carrier particles and toner particles through the development zone formed by the first and the second magnetic rolls.

14. The subsystem of claim 13 wherein the motor drives the first sleeve at a rotational speed that is approximately 1.5 times a rotational speed at which the photoreceptor moves about the circuit.

15. The subsystem of claim 13 wherein the motor drives the second sleeve at a rotational speed that is approximately 1.1 times a rotational speed at which the photoreceptor moves about the circuit.

16. The subsystem of claim 14 wherein the motor drives the second sleeve at a rotational speed that is approximately 1.1 times a rotational speed at which the photoreceptor moves about the circuit.

* * * * *